US010463072B2

(12) United States Patent
Snyder

(10) Patent No.: US 10,463,072 B2
(45) Date of Patent: Nov. 5, 2019

(54) MULTI-ARMED PRE-ROLLED SMOKING TUBE

(71) Applicant: Dantaye Snyder, Raleigh, NC (US)

(72) Inventor: Dantaye Snyder, Raleigh, NC (US)

( * ) Notice: Subject to any disclaimer, the term of this patent is extended or adjusted under 35 U.S.C. 154(b) by 145 days.

(21) Appl. No.: 15/699,809

(22) Filed: Sep. 8, 2017

(65) Prior Publication Data

US 2019/0075843 A1 Mar. 14, 2019

(51) Int. Cl.
*A24F 13/22* (2006.01)
*A24F 13/08* (2006.01)

(52) U.S. Cl.
CPC ..... *A24F 13/22* (2013.01); *A24F 13/08* (2013.01)

(58) Field of Classification Search
None
See application file for complete search history.

(56) References Cited

U.S. PATENT DOCUMENTS 1,302,047 A * 4/1919 Hurst ..... A24F 1/00 131/180
4,171,703 A * 10/1979 Locke ..... A24F 5/00 131/173
4,183,365 A * 1/1980 Kelley ..... A24F 1/26 131/173
6,418,936 B1 * 7/2002 Lee ..... A24F 5/00 131/178
2010/0326453 A1 * 12/2010 Chaoui ..... A24F 1/30 131/173
2018/0228211 A1 * 8/2018 Eckhoff ..... A24F 5/10

* cited by examiner

*Primary Examiner* — Dennis R Cordray
(74) *Attorney, Agent, or Firm* — Williams Intellectual Property

(57) ABSTRACT

A multi-armed pre-rolled smoking tube that includes a primary tubular body with a proximal end and a distal end, and a secondary tubular body with a pair of transverse ends, wherein primary and secondary tubular bodies are angularly disposed through mating engagement by an annulet sleeve portion medially disposed within the secondary tubular body. Sealed engagement of the annulet sleeve portion around the exterior surface of the primary tubular body is affective to enclose a pair of perforated regions diametrically disposed upon the primary tubular body. The sealed junction therefore connects the pair of transverse ends with the primary tubular body, and allows airflow through the multi-armed pre-rolled smoking tube enabling combustion of vegetable matter additional to the multi-armed pre-rolled smoking tube at each of the pair of transverse ends and the distal end for inhalation through a mouthpiece.

11 Claims, 4 Drawing Sheets

MULTI-ARMED PRE-ROLLED SMOKING TUBE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Smoking is attractive to consumers for a variety of reasons. Some individuals smoke for pleasure, some for medicinal purposes, and others to make a personal statement. Whatever the reason, consumers enjoy novel smoking apparatuses that make their smoking experience more enjoyable, convenient, and cost-effective.

Various types of pre-rolled paper smoking tubes are known in the prior art and are devised as a convenient alternative to home rolled papers, whereby a user may fill the pre-rolled paper smoking tubes with vegetable matter additional to the arm of the rolled paper and light at its end for inhalation at the mouthpiece. The majority of these pre-rolled smoking papers are tubular shaped, containing only one arm that a user may fill with vegetable matter. However, what is needed is a multi-armed pre-rolled smoking tube that includes a primary tubular body and a secondary tubular body angularly engaged by an annulet sleeve portion, whereby vegetable matter is additional to all three arms of the multi-armed pre-rolled smoking tube to give greater potency of a draw per inhalation. The multi-armed pre-rolled smoking tube's angularly engaged members maintain an airtight seal at the annulet sleeve portion where the arms of the multi-armed pre-rolled smoking tube conjoin, which allow for a steady draw from all three arms of the multi-armed pre-rolled smoking tube thereby combining three draws into one. The present multi-armed pre-rolled smoking tube has been devised to expedite and enhance a consumer's smoking experience by presenting combustible material such as smoking paper in a pre-rolled, pre-sealed form, whereby an increased volume of vegetable matter may be consumed when added and smoked in the multi-armed pre-rolled smoking tube. Being preformed, the multi-armed pre-rolled smoking tube limits leakage that often occurs along the sealed seam of a home rolled paper, and also negates the skill required to roll a smoking paper. In addition to its functional usage, the novel design of the multi-armed pre-rolled smoking tube allows for a novel type of smoking, whereby individuals may enjoy a trendy option to that of prior art.

FIELD OF THE INVENTION

The present invention relates to preformed smoking articles and more particularly, to a multi-armed pre-rolled smoking tube that provides consumers with a novel method of smoking that is convenient, unique, and cost-effective.

The present invention includes a primary tubular body and a secondary tubular body angularly engaged by an annulet sleeve portion, whereby vegetable matter may be add to the three arms of the multi-armed pre-rolled smoking tube to increase the potency of a draw per inhalation compared to prior art. The multi-armed pre-rolled smoking tube's angularly engaged members maintain an airtight seal by the annulet sleeve portion, which attributes to its convenience and reliability as a smoking apparatus. As a preformed, self-sealed smoking tube, the multi-armed pre-rolled smoking tube circumvents the hassle of a home rolled paper, which often leaks due to improper sealing along its seam and requires deft and practiced hands to assemble. The unique design of the multi-armed pre-rolled smoking tube is also a smoking novelty, where function and design interconnect to make the multi-armed pre-rolled smoking tube uniquely marketable and attractive to consumers.

SUMMARY OF THE INVENTION

Inhalation through a smoking apparatus is dependent on maintenance of an airtight seal along the seam of a rolled paper, whereby the paper may be filled with vegetable matter, rolled and lit. There are many types of preformed smoking apparatuses that function as an alternative to home rolled smoking papers, which often are improperly sealed and inconvenient to roll. These preformed smoking apparatuses as seen in the prior art are predominantly composed of a single arm in which vegetable matter may be added thereto.

The present multi-armed pre-rolled smoking tube has been devised to enhance and consolidate a consumer's smoking experience by providing a preformed smoking apparatus that increases the volume of vegetable matter consumed, while maintaining a proper seal. The multi-armed pre-rolled smoking tube is cross-shaped to provide three locations in which vegetable matter may be added and lit. Therefore, each multi-armed pre-rolled smoking tube consumed contains approximately double the vegetable matter compared to that of prior art, and functions by combining three draws into one. Additionally, the present multi-armed pre-rolled smoking tube maintains draw and holds an airtight seal along both the seams of the tubular bodies and the annulet sleeve that conjoins the angularly engaged members. As a pre-rolled smoking tube, a consumer can expediently enjoy their smoking experience using the multi-armed pre-rolled smoking tube without the inconvenience of rolling and sealing a smoking paper beforehand. The present multi-armed pre-rolled smoking tube therefore allows for consistent enjoyment, minimal inconvenience, and increased load delivery.

The present multi-armed pre-rolled smoking tube includes a primary tubular body and a secondary tubular body angularly engaged by an annulet sleeve portion. The primary tubular body and the secondary tubular body are constructed from rectilinear combustible material such as smoking paper as commonly seen in the art, each curved and adhered along a length thereof, said material devised to be homogenous and burn evenly when lit.

Both the primary tubular body and secondary tubular body have an exterior surface and an interior surface, as well as a channel that lies angular to its complement when said tubular members are engaged.

The primary tubular body includes both a proximal end and a distal end, as well as a pair of diametrically disposed perforated regions through the surface of the primary tubular body more proximal the distal end. The primary tubular body is constructed of rectilinear combustible material of increasing thickness towards the proximal end, whereby the lit distal end may be extinguished as it proceeds down the primary tubular body towards said proximal end.

The secondary tubular body includes an annulet sleeve portion disposed medially thereon between a pair of transverse ends, whereby the annulet sleeve portion enables sealed engagement of the secondary tubular body around the primary tubular body to present the tubular bodies in the form of a cross. The angular engagement of the two tubular bodies by the annulet sleeve portion allows for enclosure of the pair of perforated regions of the primary tubular body, whereby the channel of the secondary tubular body faces the pair of angularly disposed perforated regions. Engagement of the annulet sleeve portion around the circumference of the primary tubular body is such that it produces an airtight seal, thereby connecting the pair of transverse ends of the secondary tubular body and the primary tubular body to give airflow throughout the entire multi-armed pre-rolled smoking tube. Sealed engagement of the annulet sleeve portion adjacently contacting the exterior surface of the primary tubular body is dependent on the circumference of the sleeve, which must be complementary to the circumference of the primary tubular body at it's perforated regions. The annulet sleeve portion allows for connected airflow through the ends of the primary and secondary tubular bodies in order to maintain an even draw when the multi-armed pre-rolled smoking tube is lit.

The primary tubular body also contains a mouthpiece at its proximal end through which inhalation can be initiated. The mouthpiece includes a filter tip disposed within the proximal end of the primary tubular body. The filter tip is constructed of thick rectilinear paper material where one end is folded into a crenate shape and enclosed by the curved other end to compose a cylindrical shell with an interiorly disposed crenate fold. The filter tip is cylindrically shaped to allow it to be inserted within the proximal end of the primary tubular body, which in conjunction makes up the mouthpiece of the multi-armed pre-rolled smoking tube. The filter tip functions as a filter to maintain stuffed vegetable matter within the primary and secondary tubular bodies and to prevent inadvertent removal therefrom during smoking as the multi-armed pre-rolled smoking tube is lit and used.

Thus has been broadly outlined the more important features of the present multi-armed pre-rolled smoking tube so that the detailed description thereof that follows may be better understood and in order that the present contribution to the art may be better appreciated.

Objects of the present multi-armed pre-rolled smoking tube, along with various novel features that characterize the invention, are particularly pointed out in the claims forming a part of this disclosure. For better understanding of the multi-armed pre-rolled smoking tube, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
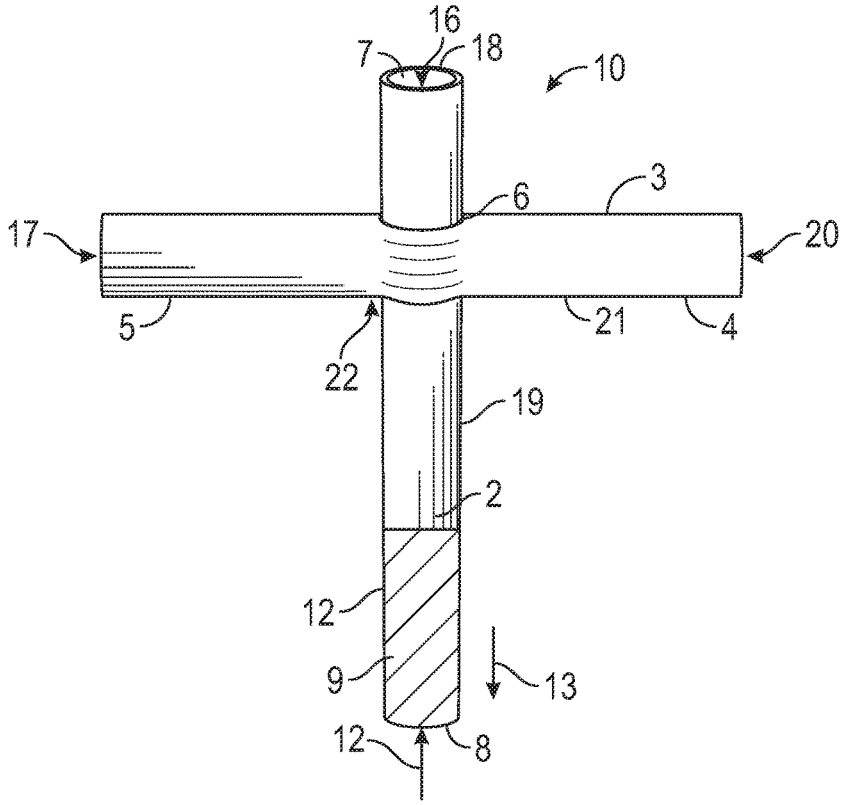
FIG. 1 is a top elevation view of an example embodiment
Figure 2:
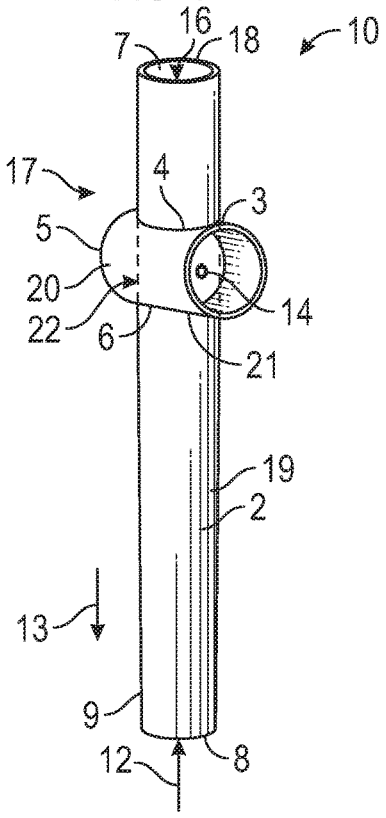
FIG. 2 is a side elevation view of an example embodiment
Figure 3:
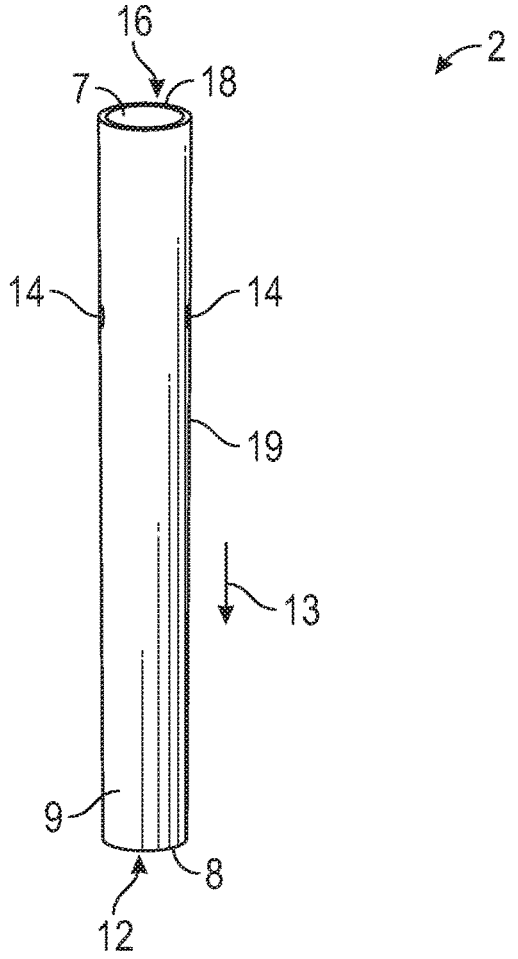
FIG. 3 is a top elevation of an example embodiment of a primary tubular body
Figure 4:
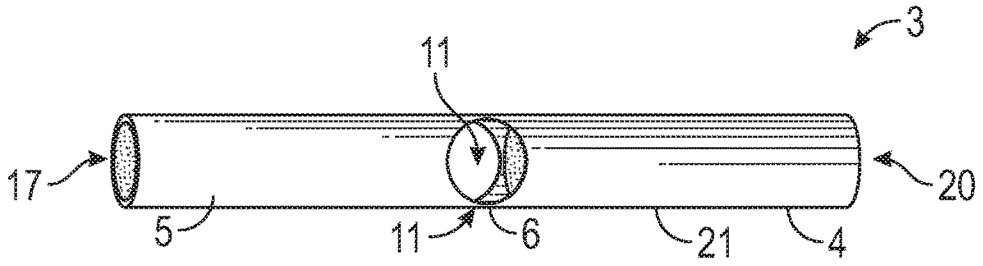
FIG. 4 is a front isometric view of an example embodiment of a secondary tubular body
Figure 5:
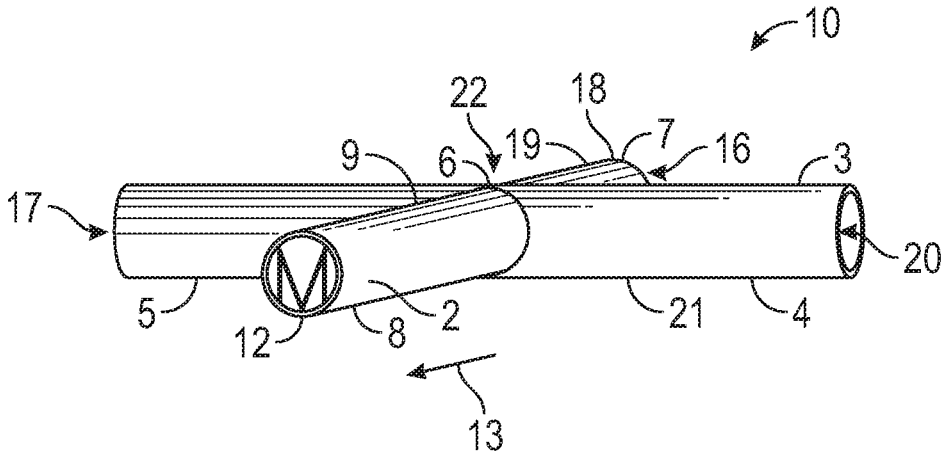
FIG. 5 is a rear elevation view of an example embodiment
Figure 6:
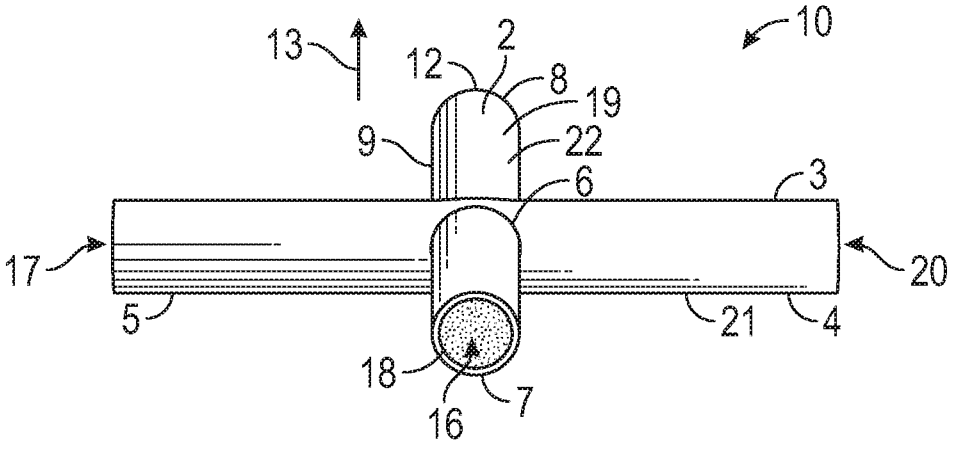
FIG. 6 is a front elevation view of an example embodiment
Figure 7:
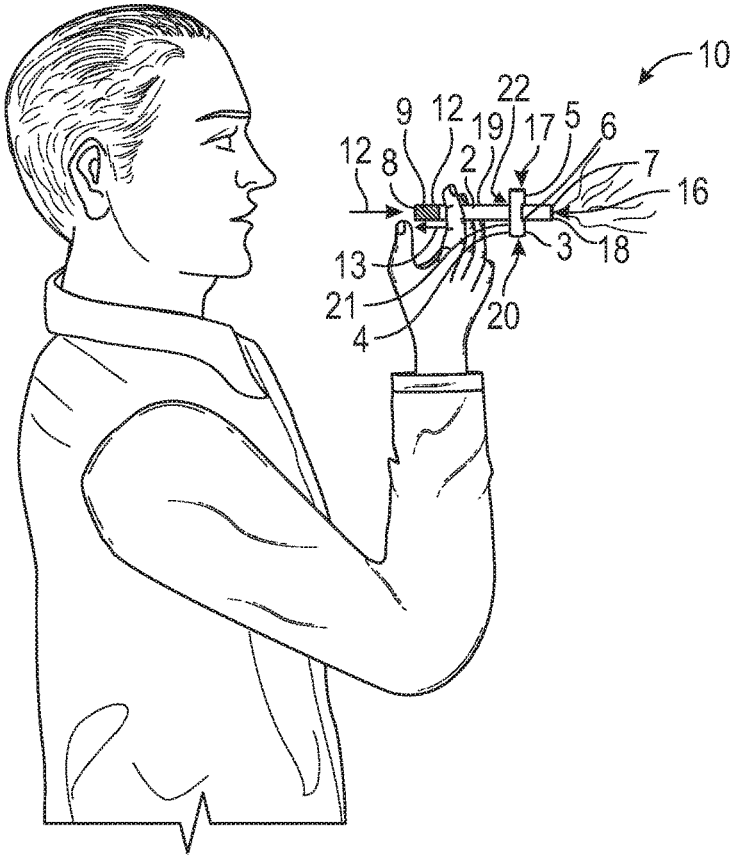
FIG. 7 is an in-action view of an example embodiment
Figure 8:
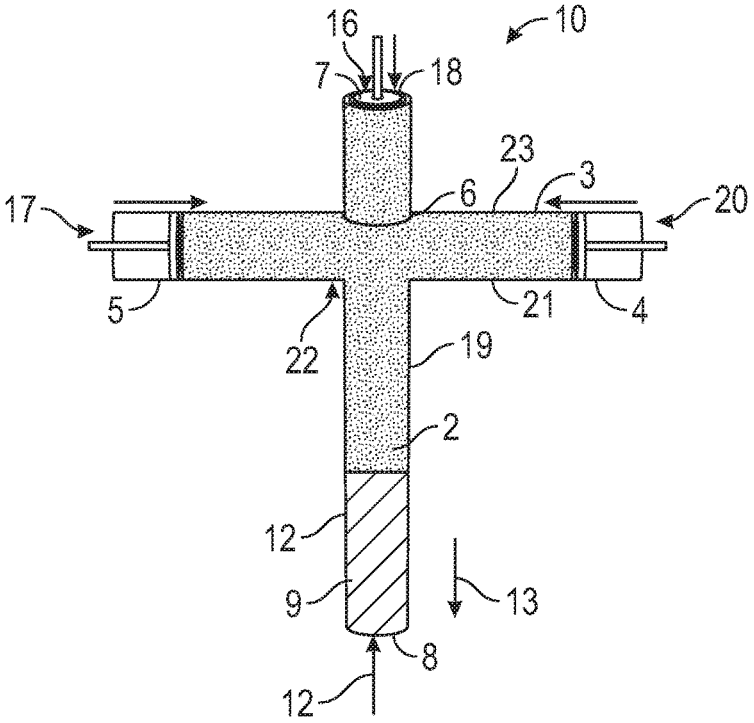
FIG. 8 is a functional example of an example embodiment

With reference now to the drawings, and in particular FIGS. 1 through 8 thereof, an example of the instant multi-armed pre-rolled smoking tube employing the principles and concepts of the present multi-armed pre-rolled smoking tube and generally designated by the reference number 10 will be described.

Referring to FIGS. 1 through 8 a preferred embodiment of the present multi-armed pre-rolled smoking tube 10 is illustrated.

The present multi-armed pre-rolled smoking tube 10 has been devised to expedite and enhance a consumer's smoking experience by presenting combustible material such as smoking paper in a pre-rolled, pre-sealed form, whereby an increased volume of vegetable matter may be consumed when added and smoked in the multi-armed pre-rolled smoking tube 10.

In a preferred embodiment, the present multi-armed pre-rolled smoking tube 10 includes a primary tubular body 2 and a secondary tubular body 3 angularly engaged by an annulet sleeve portion 6. The primary tubular body 2 and the secondary tubular body 3 are constructed of paper material curved and adhered along a length thereof. The primary tubular body 2 includes a proximal end 8, a distal end 7, an exterior surface 19, an interior surface 18, and a channel 16. The primary tubular body 2 is constructed of rectilinear paper material of increasing paper thickness 13 towards the proximal end 8, whereby a lit end may be extinguished as it proceeds down the primary tubular body 2 toward the proximal end 8. A pair of perforated regions 14 are also diametrically disposed upon the primary tubular body 2 nearer the distal end 7.

The secondary tubular body 3 includes a second exterior surface 21, a second interior surface 20 and a second channel 17, with said channels 16, 17 disposed angular to each other when said tubular members 2, 3 are engaged. The secondary tubular body 3 includes an annulet sleeve portion 6 disposed medially thereon between a pair of transverse ends 4,5. The annulet sleeve 6 including a complimentary pair of apertures 11 diametrically disposed upon the secondary tubular body 3, whereby insertion of the primary tubular body 2 therethrough results in sealed engagement to present said tubular bodies 3,2 in the form of a cross. The annulet sleeve portion 6 adjacently contacts the exterior surface 19 of the primary tubular body 2, whereby securement of said annulet sleeve 6 is dependent on the circumference of said pair of apertures 11, which are complementary to the circumference of the primary tubular body 2. The proximal end 8 of the primary tubular body 2 is smaller in circumference than the distal end 7, which allows the annulet sleeve 6 to be wedged around the primary tubular body's 2 exterior surface 19 at the pair of perforated regions 14 by the restricting circumference of the primary tubular body 2. Engagement of the tubular members 2,3 produces an airtight seal to enclose the pair of perforated regions 14 of the primary tubular body 2 with the pair transverse ends 4,5, thereby giving connected airflow through the multi-armed pre-rolled smoking tube 10.

A mouthpiece 9 is disposed at the proximal end 8 of the primary tubular body 2, said mouthpiece 9 including a filter tip 12 of paper material disposed within the proximal end 8 of the primary tubular body 2. The filter tip 12 is cylindrical and constructed of rectilinear paper material, wherein one end is folded into a crenate shape and enclosed by the curved other end to compose a cylindrical shell with an interiorly disposed crenate fold. The filter tip 12 functions as a filter to maintain stuffed vegetable matter 23 within the primary and secondary tubular bodies 2,3 to prevent inadvertent removal therefrom during smoking as the multi-armed pre-rolled smoking tube 10 is lit and used.

What is claimed is:

1. A multi-armed pre-rolled smoking tube comprising:

a primary tubular body having a proximal end, a distal end, an interior surface, an exterior surface and a channel;

a pair of perforated regions diametrically disposed upon the surface of the primary tubular body;

a secondary tubular body angularly disposed to the primary tubular body, said secondary tubular body comprising:

a first transverse end;

a second transverse end;

a second interior surface;

a second exterior surface;

a second channel;

an annulet sleeve portion medially disposed on the secondary tubular body, said annulet sleeve portion comprising a complementary pair of apertures configured to accept insertion of the primary tubular body therethrough to form a sealed engagement around the primary tubular body; and a mouth piece disposed at the proximal end of the primary tubular body;

wherein the annulet sleeve portion engages around the primary tubular body as a seal to enclose the pair of perforated regions with the transverse ends of the secondary body, whereby combustion of vegetable matter additional to the multi-armed pre-rolled smoking tube commenced at each of the pair of transverse ends and the distal end enables inhalation through the mouthpiece.

2. The multi-armed pre-rolled smoking tube of claim 1 wherein the primary tubular body and secondary tubular body are engaged by the annulet sleeve portion in the shape of a cross.

3. The multi-armed pre-rolled smoking tube of claim 2 wherein the annulet sleeve is securable around the exterior surface of the primary tubular body through said pair of complementary apertures to enclose the pair of perforated regions with the first and second of transverse ends thereby forming a sealed junction connecting the interior of the secondary tubular body with the interior of the primary tubular body.

4. The multi-armed pre-rolled smoking tube of claim 3 wherein the second channel of the secondary tubular body encloses the pair of diametrically disposed perforated regions of the primary tubular body.

5. The multi-armed pre-rolled smoking tube of claim 4 wherein the annulet sleeve portion contacts the exterior surface of the primary tubular body to produce an airtight seal around the circumference of the primary tubular body at said perforated regions.

6. The multi-armed pre-rolled smoking tube of claim 5 wherein the distal end of the primary tubular body is larger in circumference than the proximal end, whereby the annulet sleeve is wedged by the restricting circumference in order to secure around the primary body's exterior surface at the pair of perforated regions.

7. The multi-armed pre-rolled smoking tube of claim 6 wherein the pair of perforated regions are disposed closer to the distal end than to the proximal end of the primary tubular body.

8. The multi-armed pre-rolled smoking tube of claim 7 wherein the primary tubular body is constructed of rectilinear paper material of increasing paper thickness towards the proximal end, whereby the lit distal end may be extinguished as it proceeds down the primary tubular body towards said proximal end.

9. The multi-armed pre-rolled smoking tube of claim 8 wherein the primary tubular body and the secondary tubular body are constructed from rectilinear paper material curved and adhered along a length thereof, said paper material devised to be homogenous and burn evenly when lit.

10. The multi-armed pre-rolled smoking tube of claim 9 wherein the mouthpiece comprises a tip filter tip of paper material disposed within the proximal end of the primary tubular body wherein the filter tip is constructed of rectilinear paper material folded on one end to form a pleat and rolled to compose a cylindrical shell with the pleat enclosed interiorly along a height therein, said filter tip thereby disposed to prevent withdrawal of material through the mouthpiece.

11. A multi-armed pre-rolled smoking tube comprising:

a primary tubular body of rectilinear paper material curved and adhered along a length thereof, said primary tubular body comprising:

a proximal end;

a distal end of decreased paper thickness and increased diameter than said proximal end;

an interior surface;

an exterior surface;

a channel; and a pair of perforated regions diametrically disposed upon the primary tubular body, each of said pair of perforated regions more proximal the distal end;

a secondary tubular body of rectilinear paper material adhered along a length thereof, said secondary tubular body angularly disposed to the primary tubular body, said secondary tubular body comprising:

a first transverse end;

a second transverse end;

a second interior surface;

a second exterior surface;

a second channel; and an annulet sleeve portion medially disposed upon the secondary tubular body, said annulet sleeve portion comprising a complementary pair of apertures configured to accept insertion of the primary tubular body therethrough to form a sealed engagement around the primary tubular body while accommodating primary tubular body's pair of perforated regions; and a mouthpiece disposed at the proximal end of the primary tubular body, said mouthpiece comprising a filter tip of paper material disposed within the proximal end of the primary tubular body, said filter tip constructed of rectilinear paper material folded on one end into a pleat and rolled to compose a cylindrical shell with the pleat enclosed interiorly along a height therein, said filter tip thereby disposed to prevent withdrawal of vegetable matter through the mouthpiece;

wherein the annulet sleeve portion engages around the primary tubular body as a seal to enclose the pair of perforated regions with the transverse ends of the secondary body, whereby combustion of vegetable matter additional to the multi-armed pre-rolled smoking tube commenced at each of the pair of transverse ends and the distal end enables inhalation through the mouthpiece.

* * * * *